US008956131B2

(12) United States Patent
Nakamura et al.

(10) Patent No.: US 8,956,131 B2
(45) Date of Patent: Feb. 17, 2015

(54) SCROLL COMPRESSOR

(75) Inventors: Souichi Nakamura, Sakai (JP); Shuuichi Joumura, Sakai (JP); Kenji Nagahara, Sakai (JP); Hiroshi Kitaura, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 237 days.

(21) Appl. No.: 13/578,248

(22) PCT Filed: Feb. 14, 2011

(86) PCT No.: PCT/JP2011/000814

§ 371 (c)(1),
(2), (4) Date: Aug. 9, 2012

(87) PCT Pub. No.: WO2011/099308

PCT Pub. Date: Aug. 18, 2011

(65) Prior Publication Data

US 2012/0315173 A1 Dec. 13, 2012

(30) Foreign Application Priority Data

Feb. 15, 2010 (JP) ..... 2010-030624

(51) Int. Cl.
*F01C 1/02* (2006.01)
*F01C 1/063* (2006.01)
(Continued)

(52) U.S. Cl.
CPC ..... *F04C 18/0215* (2013.01); *F04C 18/0253* (2013.01); *F04C 18/0276* (2013.01);
(Continued)

(58) Field of Classification Search
CPC ..... F04C 18/0269; F04C 18/0276; F04C 18/0246; F04C 18/0253; F04C 18/0215; F04C 23/008; F04C 29/042
USPC ..... 418/55.2, 55.5, 55.6, 60
See application file for complete search history.

(56) References Cited

U.S. PATENT DOCUMENTS 5,037,278 A 8/1991 Fujio et al.
5,253,489 A * 10/1993 Yoshii ..... 418/55.2
(Continued)

FOREIGN PATENT DOCUMENTS

JP 2-9974 A 1/1990
JP 2-9974 A 1/1990
(Continued)

OTHER PUBLICATIONS

International Search Report of corresponding PCT Application No. PCT/JP2011/000814.

*Primary Examiner* — Thai Ba Trieu
*Assistant Examiner* — Deming Wan
(74) *Attorney, Agent, or Firm* — Global IP Counselors

(57) ABSTRACT

A scroll compressor includes a fixed scroll, an orbiting scroll and an injection passage. Each scroll has an end plate and a spiral lap. The scrolls mesh with each other to form a compression chamber. The injection passage supplies intermediate pressure refrigerant and refrigeration oil separated from discharged refrigerant to the compression chamber. At least one of the scrolls has a bottom land facing the lap of the other of the scrolls. The bottom land has an intermediate bottom region facing a part of the compression chamber communicating with the injection passage, and a suction side bottom region located closer to an outer end of the lap than the intermediate bottom region. A clearance between the suction side bottom region and the end face of the lap is larger than a clearance between the intermediate bottom region and the end face of the lap.

3 Claims, 4 Drawing Sheets

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 18/02*** | (2006.01) |
| ***F04C 23/00*** | (2006.01) |
| ***F04C 27/00*** | (2006.01) |
| ***F04C 29/04*** | (2006.01) |
| *F04C 29/02* | (2006.01) |

(52) U.S. Cl.

CPC ..... *F04C23/008* (2013.01); *F04C 27/005* (2013.01); *F04C 29/042* (2013.01); *F04C 29/026* (2013.01); *F04C 2270/17* (2013.01)

USPC ..... 418/55.2; 418/55.6

(56) References Cited

U.S. PATENT DOCUMENTS

| | | | | |
|---|---|---|---|---|
| 2003/0021712 | A1* | 1/2003 | Fujita et al. ..... | 418/55.2 |
| 2007/0178002 | A1 | 8/2007 | Hiwata et al. | |
| 2007/0212246 | A1 | 9/2007 | Jeong et al. | |

FOREIGN PATENT DOCUMENTS

| | | | |
|---|---|---|---|
| JP | 2005-9332 | A | 1/2005 |
| JP | 2007-178052 | A | 7/2007 |
| JP | 2007-239747 | A | 9/2007 |
| JP | 2008-309124 | A | 12/2008 |
| JP | 2008-309124 | A | 12/2008 |

* cited by examiner

SCROLL COMPRESSOR

CROSS-REFERENCE TO RELATED APPLICATIONS

This U.S. National stage application claims priority under 35 US §119(a) to Japanese Patent Application No. 2010-030624, filed in Japan on Feb. 15, 2010, the entire contents of which are hereby incorporated herein by reference.

TECHNICAL FIELD

The present invention relates to a scroll compressor connected to a refrigerant circuit to compress a refrigerant,

BACKGROUND ART

Scroll compressors have widely been used as compressors connected to a refrigerant circuit for performing a refrigeration cycle to compress a refrigerant. The scroll compressor includes a fixed scroll and an orbiting scroll, each of which has an end plate and a spiral lap protruding from a front surface of the end plate. The laps of the fixed scroll and the orbiting scroll mesh with each other to form a compression chamber. When the orbiting scroll revolves, a low temperature and low pressure refrigerant is sucked into the compression chamber through an outer end of the lap, and a high temperature and high pressure refrigerant compressed in the compression chamber is discharged through an inner end of the lap.

Patent Document 1 discloses a scroll compressor in which an intermediate pressure gaseous refrigerant is introduced to a compression chamber in the course of compression. In the scroll compressor disclosed by the Japanese Patent Publication No. 2007-178052, refrigeration oil separated from a refrigerant discharged from the scroll compressor is supplied to the compression chamber in the course of compression together with the intermediate pressure gaseous refrigerant.

According to a scroll compressor disclosed by 2 Japanese Patent Publication No. 2005-009332, a clearance between an end face of the lap and a front surface of the end plate facing each other is gradually increased in a direction from an outer end of the lap to an inner end of the lap. In this scroll compressor, the clearance between the lap and the end plate is increased with decreasing distance from the inner end of the lap where temperature is high and significant thermal expansion occurs, so that the clearance between the lap and the end plate is not reduced too much when the scroll compressor is operated.

SUMMARY OF THE INVENTION

Technical Problem

As described in Japanese Patent Publication No. 2007-178052, in the scroll compressor configured to introduce the intermediate pressure gaseous refrigerant to the compression chamber in the course of compression, the refrigeration oil discharged from the scroll compressor together with the refrigerant may be sent back to the compression chamber in the course of compression together with the intermediate pressure gaseous refrigerant. The refrigeration oil flowed into the compression chamber moves toward the inner end of the tap together with the refrigerant in the compression chamber. Thus, in the scroll compressor configured to introduce the intermediate pressure gaseous refrigerant to the compression chamber in the course of compression, a sufficient amount of the refrigeration oil is supplied to part of the compression chamber between a position through which the intermediate pressure gaseous refrigerant enters the compression chamber and the inner end of the lap, but is not sufficiently be supplied to part of the compression chamber between the position through which the intermediate pressure gaseous refrigerant enters the compression chamber and the outer end of the lap. In this case, lubrication between the lap and the end plate may be insufficient.

In particular, according to the scroll compressor disclosed by Japanese Patent Publication No. 2005-009332, the clearance between the end face of the lap and the front surface of the end plate facing each other is reduced with decreasing distance from the outer end of the lap. Thus, when the scroll compressor of the Patent Document 2 is configured to introduce the intermediate pressure gaseous refrigerant to the compression chamber in the course of compression, the clearance between the lap and the end plate near the outer end of the lap may be reduced, although the sufficient amount of the refrigeration oil is not easily supplied thereto. This may possibly cause troubles such as seizing etc.

In view of the foregoing, the present invention has been achieved. The invention is directed to a scroll compressor configured to introduce an intermediate pressure gaseous refrigerant to a compression chamber in the course of compression, and is concerned with improving reliability of the scroll compressor by preventing troubles caused by insufficient lubrication.

Solution to the Problem

A first aspect of the present invention is directed to a scroll compressor including: a fixed scroll (30) and an orbiting scroll (40), each having an end plate (31, 41), and a spiral lap (32, 42) protruding from a front surface of the end plate (31, 41), wherein the fixed scroll (30) and the orbiting scroll (40) mesh with each other in such a manner that an end face (42*a*, 32*a*) of the lap (42, 32) of one of the fixed scroll (30) or the orbiting scroll (40) faces the front surface of the end plate (31, 41) of the other of the fixed scroll (30) and the orbiting scroll (40) to form a compression chamber (25), and the scroll compressor is connected to a refrigerant circuit for performing a refrigeration cycle to compress a refrigerant sucked into the compression chamber (25). The scroll compressor includes an injection passage (27) through which an intermediate pressure refrigerant is supplied to the compression chamber (25) in the course of compression, refrigeration oil separated from a refrigerant discharged from the scroll compressor is supplied to the injection passage (27) together with the intermediate pressure refrigerant, a bottom land (31*a*, 41*a*) which is part of the front surface of the end plate (31, 41) facing the lap (42, 32) has an intermediate bottom region (36, 46) facing the compression chamber (25) communicating with the injection passage (27), and a suction side bottom region (35, 45) which is closer to an outer end of the lap (42, 32) than the intermediate bottom region (36, 46) is, and a clearance between the suction side bottom region (35, 45) and the end face (42*a*, 32*a*) of the lap (42, 32) facing the suction side bottom region (35, 45) is larger than a clearance between the intermediate bottom region (36, 46) and the end face (42*a*, 32*a*) of the lap (42, 32) facing the intermediate bottom region (36, 46).

According to the first aspect of the invention, the fixed scroll (30) and the orbiting scroll (40) form the compression chamber (25). A low pressure refrigerant is sucked into the compression chamber (25) through an outer end of the lap (32, 42). An intermediate pressure refrigerant is introduced to the compression chamber (25) in the course of compression from the injection passage (27). When the orbiting scroll (40) moves, a capacity of the compression chamber (25) gradually decreases, and the refrigerant in the compression chamber (25) is compressed. The compressed refrigerant is discharged through an inner end of the lap (32, 42). Refrigeration oil is supplied from the injection passage (27) to the compression chamber (25) together with the intermediate pressure refrigerant, and the supplied refrigeration oil is used for lubrication.

In the first aspect of the invention, the bottom land (31*a*, 41*a*) of the end plate (31, 41) is provided with the intermediate bottom region (36, 46) and the suction side bottom region (35, 45). The refrigeration oil flowed into the compression chamber (25) from the injection passage (27) moves toward the inner end of the lap (32, 42) together with the refrigerant in the compression chamber (25). Thus, the refrigeration oil is not easily supplied to the suction side bottom region (35, 45) of the bottom land (31*a*, 41*a*) than to the intermediate bottom region (36, 46) of the bottom land (31*a*, 41*a*). According to the present invention, the clearance between the suction side bottom region (35, 45) and the end face (42*a*, 32*a*) of the lap (42, 32) is larger than the clearance between the intermediate bottom region (36, 46) and the end face (42*a*, 32*a*) of the lap (42, 32). Specifically, the larger clearance is provided between the suction side bottom region (35, 45) where the refrigeration oil flowed into the compression chamber (25) from the injection passage (27) is not easily supplied and the end face (42*a*, 32*a*) of the lap (42, 32).

According to a second aspect of the invention related to the first aspect of the invention, the bottom land (31*a*, 41*a*) has a discharge side bottom region (37-39, 47-49) which is located closer to an inner end of the lap (32, 42) than the intermediate bottom region (36, 46) is, and a clearance between the discharge side bottom region (37-39, 47-49) and the end face (42*a*, 32*a*) of the lap (42, 32) facing the discharge side bottom region (37-39, 47-49) is larger than the clearance between the intermediate bottom region (36, 46) and the end face (42*a*, 32*a*) of the lap (42, 32) facing the intermediate bottom region (36, 46).

In the second aspect of the invention, the bottom land (31*a*, 41*a*) of the end plate (31, 41) is provided with the intermediate bottom region (36, 46), the suction side bottom region (35, 45), and the discharge side bottom region (37-39, 47-49). As the refrigerant in the compression chamber (25) is compressed, and the pressure of the refrigerant is increased, the temperature of the refrigerant is increased. Thus, when the scroll compressor (10) is operated, temperature of the fixed scroll (30) and the orbiting scroll (40) increases with decreasing distance from the inner end of the lap (32, 42). However, according to the present invention, the clearance between the discharge side bottom region (37-39, 47-49) and the end face (42*a*, 32*a*) of the lap (42, 32) is larger than the clearance between the intermediate bottom region (36, 46) and the end face (42*a*, 32*a*) of the lap (42, 32). Specifically, the larger clearance is provided between the discharge side bottom region (37-39, 47-49) whose the temperature is high when the scroll compressor (10) is operated and the end face (42*a*, 32*a*) of the lap (42, 32).

According to a third aspect of the invention related to the second aspect of the invention, a clearance between an end face (42*a*, 32*a*) of the outer end of the lap (32, 42) and the bottom land (41*a*, 31*a*) facing the end face (42*a*, 32*a*) is smaller than a clearance between an end face (42*a*, 32*a*) of the inner end of the lap (32, 42) and the bottom land (41*a*, 31*a*) facing the end face (42*a*, 32*a*).

As described above, in the scroll compressor (10), the low pressure refrigerant is sucked into the compression (25) through the outer end of the lap (32, 42), and the refrigerant compressed in the compression chamber (25) is discharged through the inner end of the lap (32, 42). Thus, when the scroll compressor (10) is operated, temperature of part of the lap (32, 42) closer to the outer end is lower than temperature of part of the lap (32, 42) closer to the inner end. According to the third aspect of the invention, the clearance between the outer end of the lap (32, 42) whose temperature is relatively low and the bottom land (41*a*, 31*a*) is smaller than the clearance between the inner end of the lap (32, 42) whose temperature is relatively high and the bottom land (41*a*, 31*a*).

Advantages of the Invention

In the scroll compressor (10) of the present invention, the refrigeration oil is introduced from the injection passage (27) to the compression chamber (25) in the course of compression, and the clearance between the suction side bottom region (35, 45) where the refrigeration oil is not easily supplied and the lap (42, 32) is larger than the clearance between the intermediate bottom region (36, 46) where a sufficient amount of the refrigeration oil is supplied and the lap (42, 32). Thus, a contact pressure acted on the suction side bottom region (35, 45) of the bottom land (31*a*, 41*a*) and part of the end face (42*a*, 32*a*) of the lap (42, 32) facing the suction side bottom region (35, 45) is lower than a contact pressure acted on the intermediate bottom region (36, 46) of the bottom land (31*a*, 41*a*) and part of the end face (42*a*, 32*a*) of the lap (42, 32) facing the intermediate bottom region (36, 46). Thus, even in the suction side bottom region (35, 45) where the refrigeration oil is not easily supplied, troubles caused by insufficient lubrication, such as seizing etc. between the end plate (31, 41) and the lap (42, 32), can be prevented. This can improve reliability of the scroll compressor (10).

According to the second aspect of the invention, the clearance between the discharge side bottom region (37-39, 47-49) whose temperature is relatively high when the scroll compressor (10) is operated and the lap (42, 32) is larger than the clearance between the intermediate bottom region (36, 46) whose temperature is not as high as the discharge side bottom region (37-39, 47-49) and the lap (42, 32). Thus, even when the lap (32, 42) is thermally expanded when the scroll compressor (10) is operated, excessive reduction of the clearance between the discharge side bottom region (37-39, 47-49) and the lap (42, 32) can be prevented. Thus, the present invention can prevent seizing etc. between the discharge side bottom region (37-39, 47-49) of the bottom land (31*a*, 41*a*) and the lap (42, 32), and can further improve the reliability of the scroll compressor (10).

According to the third aspect of the invention, the clearance between the outer end of the lap (32, 42) whose temperature is relatively low when the scroll compressor (10) is operated and the bottom land (41*a*, 31*a*) is smaller than the clearance between the inner end of the lap (32, 42) whose temperature is relatively high when the scroll compressor (10) is operated and the bottom land (41*a*, 31*a*). Thus, the present invention can reduce the clearance between the suction side bottom region (35, 45) and the end face (42*a*, 32*a*) of the lap (42, 32) as much as possible, and can prevent troubles such as seizing etc. between the end plate (31, 41) and the lap (42, 32).

DESCRIPTION OF EMBODIMENTS

An embodiment of the present invention will be described in detail with reference to the drawings.

[General Configuration of Scroll Compressor]

A general configuration of a scroll compressor (10) will be described with reference to FIG. 1.

Figure 1:
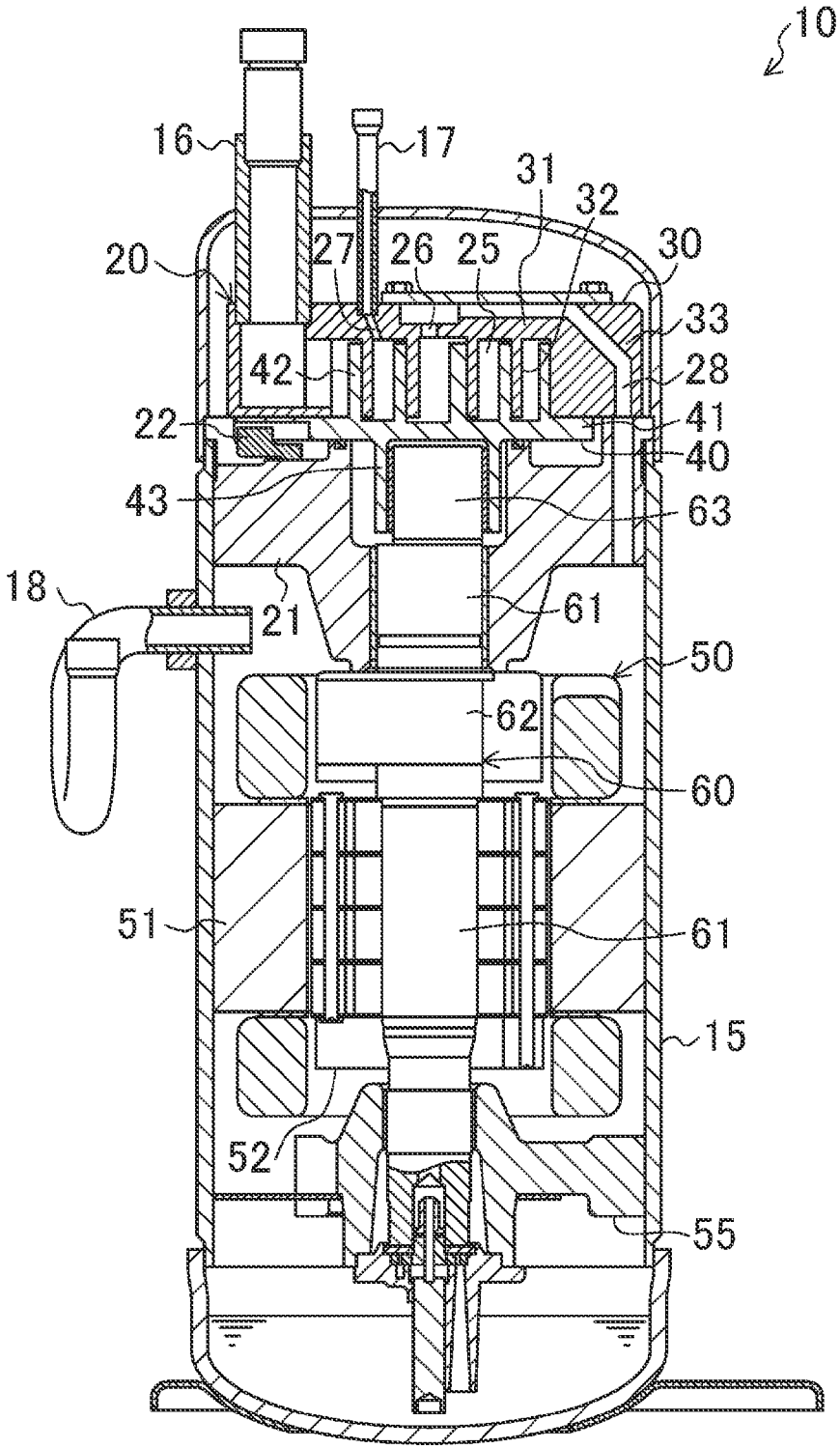
FIG. 1 is a vertical cross-sectional view showing a general configuration of a scroll compressor of an embodiment.

As shown in FIG. 1, the scroll compressor (10) of the present embodiment is a hermetically sealed compressor. The scroll compressor (10) is connected to a refrigerant circuit for performing a refrigeration cycle to compress a refrigerant sucked into the refrigerant circuit.

The scroll compressor (10) includes a compression mechanism (20), an electric motor (50), a lower bearing (55), and a drive shaft (60) which are contained in inner space of a casing (15). The casing (15) is a vertically-oriented cylindrical hermetic container. In the inner space of the casing (15), the compression mechanism (20), the electric motor (50), and the lower bearing (55) are sequentially arranged from top to bottom. The drive shaft (60) is arranged with an axial direction thereof parallel to a height direction of the casing (15).

A suction pipe (16), an injection pipe (17), and a discharge pipe (18) are attached to the casing (15). The suction pipe (16), the injection pipe (17), and the discharge pipe (18) penetrate the casing (15). The suction pipe (16) and the injection pipe (17) are connected to the compression mechanism (20). The discharge pipe (18) is opened in the inner space of the casing (15) between the electric motor (50) and the compression mechanism (20).

The lower bearing (55) is fixed to the casing (15). The lower bearing (55) rotatably supports a lower end of the drive shaft (60). The electric motor (50) includes a stator (51) and a rotor (52). The stator (51) is fixed to the casing (15). The rotor (52) is arranged coaxially with the stator (51). The drive shaft (60) is inserted in the rotor (52).

The drive shaft (60) includes a main shaft (61), a balance weight (62), and an eccentric part (63). The balance weight (62) is arranged in the middle of the main shaft (61) in the axial direction. Part of the main shaft (61) below the balance weight (62) penetrates the rotor (52) of the electric motor (50), and a lower end thereof is supported by the lower bearing (55). Part of the main shaft (61) above the balance weight (62) is rotatably supported by a housing (21) of the compression mechanism (20) described later. The eccentric part (63) protrudes from an upper end face of the main shaft (61). The eccentric part (63) has an axial center which is eccentric to an axial center of the main shaft (61), and engages with an orbiting scroll (40) of the compression mechanism (20) described later.

Although not shown, the drive shaft (60) is provided with an oil supply passage. An end of the oil supply passage is opened in a lower end of the drive shaft (60), and the other end is opened in an upper end of the drive shaft (60). When the drive shaft (60) rotates, refrigeration oil stored in a bottom of the casing (15) is sucked into the oil supply passage. A branch passage extending in a radial direction of the drive shaft (60) is provided in the oil supply passage. Part of the refrigeration oil flowing through the oil supply passage flows into the branch passage, and is supplied to sliding parts of the lower bearing (55) and the compression mechanism (20).

[Compression Mechanism]

A configuration of a compression mechanism (20) will be described with reference to FIGS. 1-3.

Figure 2:
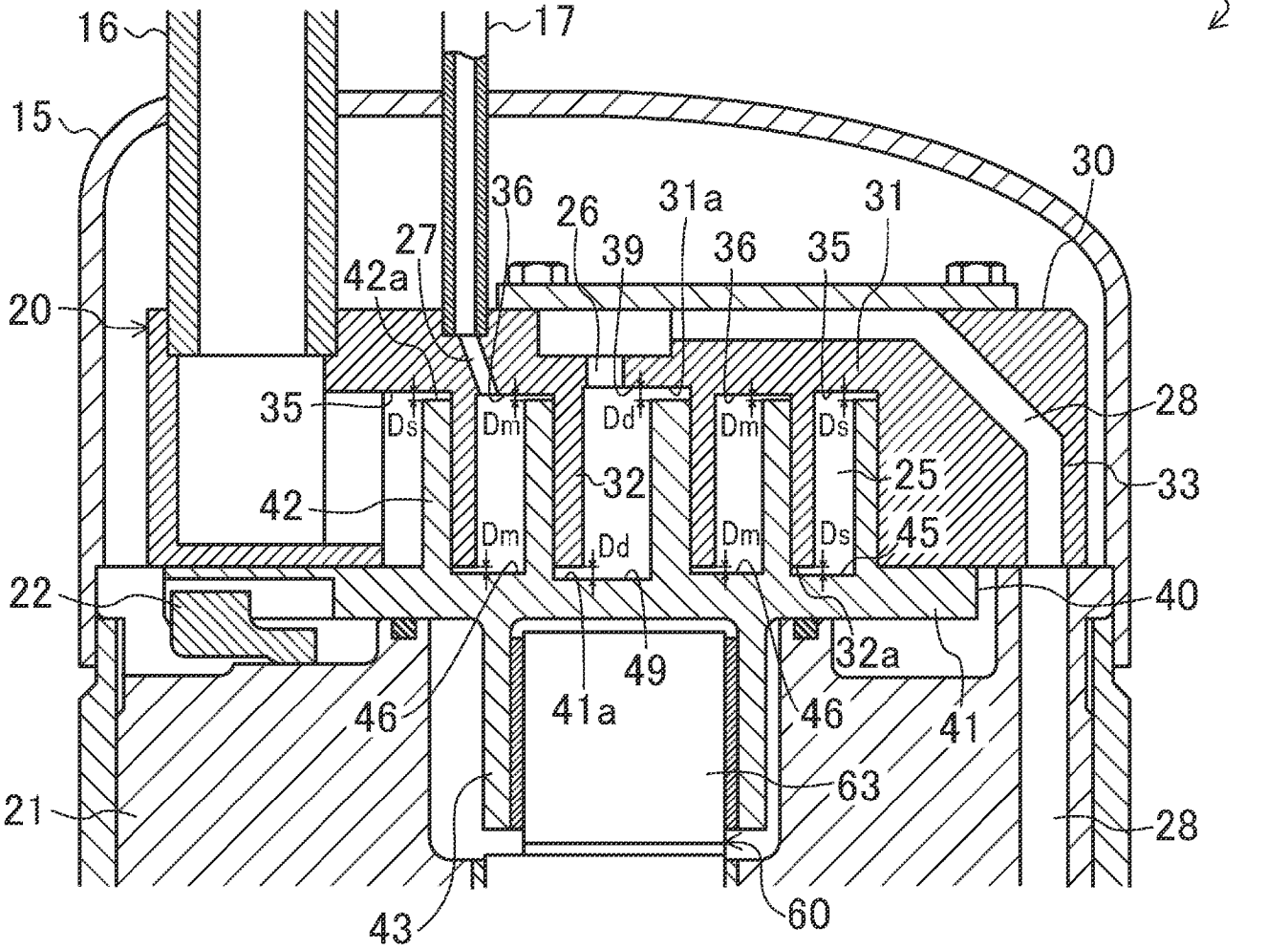
FIG. 2 is a vertical cross-sectional view of a compression mechanism of the scroll compressor of the embodiment.
Figure 3:
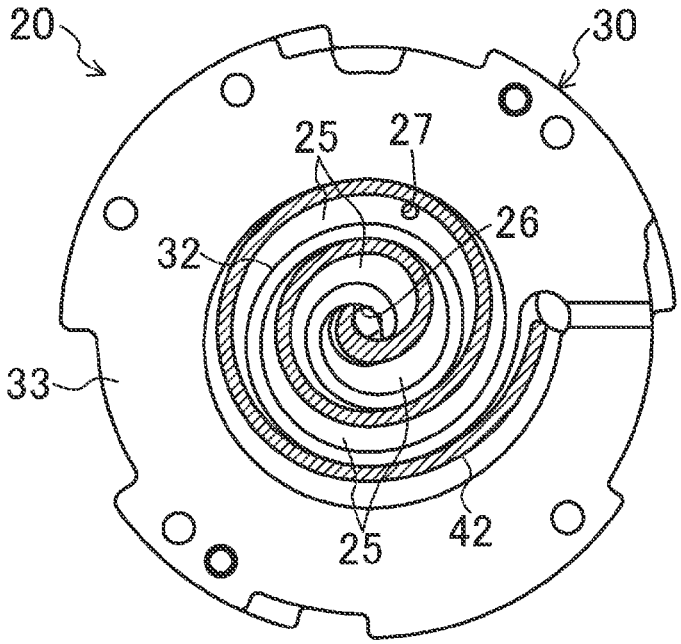
FIG. 3 is a horizontal cross-sectional view of a major part of the compression mechanism of the embodiment.

As shown in FIGS. 1 and 2, the compression mechanism (20) includes a housing (21), a fixed scroll (30), and an orbiting scroll (40). The compression mechanism (20) further includes an Oldham ring (22) for restricting rotation of the orbiting scroll (40).

The housing (21) is in the shape of a thick disc, and a center part thereof bulges downward in FIG. 1. An outer peripheral surface of the housing (21) is in contact with an inner peripheral surface of the casing (15), and the housing (21) is fixed to the casing (15). The main shaft (61) of the drive shaft (60) penetrates the center part of the housing (21). The housing (21) constitutes a journal bearing which roatably supports part of the main shaft (61) above the balance weight (62).

The fixed scroll (30) and the orbiting scroll (40) are placed on the housing (21). The fixed scroll (30) is fixed to the housing (21) with bolts etc. The orbiting scroll (40) is not fixed to the housing (21), and engages with the drive shaft (60) to revolve.

The orbiting scroll (40) is a member formed by integrating an orbiting end plate (41), an orbiting lap (42), and a cylindrical part (43). The orbiting end plate (41) is in the shape of a disc. The orbiting lap (42) is in the shape of a spiral, and protrudes from a front surface upper surface in FIG. 1) of the orbiting end plate (41). The cylindrical part (43) is cylindrical, and protrudes from a back surface (a lower surface in FIG. 1) of the orbiting end plate (41). The eccentric part (63) of the drive shaft (60) is inserted in the cylindrical part (43).

The fixed scroll (30) is a member formed by integrating a fixed end plate (31) and a fixed lap (32). The fixed end plate (31) is in the shape of a disc. The fixed lap (32) is in the shape of a spiral, and protrudes from a front surface (a lower surface in FIG. 1) of the fixed end plate (31). The fixed end plate (31) includes a part (33) surrounding the fixed lap (32). An inner side surface of the part (33) slides on the orbiting lap (42) together with the fixed lap (32) to form a compression chamber (25).

A discharge port (26) and an injection port (27) are formed in the fixed end plate (31). The discharge port (26) is a through hole formed near a center of the fixed end plate (31), and penetrates the fixed end plate (31) in a thickness direction. The discharge port (26) is opened in a front surface of the fixed end plate (31) to be located near an inner end of the fixed lap (32). The injection port (27) is a through hole formed in the fixed end plate (31) slightly outside the discharge port (26) in a radial direction, and penetrates the fixed end plate (31) in the thickness direction. The injection pipe (17) is connected to the injection port (27). The injection port (27) forms an injection passage together with the injection pipe (17). The suction pipe (16) is inserted in the fixed end plate (31) near an outer periphery of the fixed end plate.

A discharge gas passage (28) is formed in the compression mechanism (20). The discharge gas passage (28) is formed to extend from the fixed scroll (30) to the housing (21). An end of the discharge gas passage (28) communicates with the discharge port (26), and the other end is opened in a lower surface of the housing (21).

In the compression mechanism (20), the fixed scroll (30) and the orbiting scroll (40) are arranged in such a manner that the front surface of the fixed end plate (31) and the front surface of the orbiting end plate (41) face each other, and the fixed lap (32) and the orbiting lap (42) mesh with each other. Specifically, an end face (32*a*) of the fixed lap (32) faces the front surface of the orbiting end plate (41). Part of the orbiting end plate (41) facing the end face (32*a*) of the fixed lap (32) is a bottom land (41*a*). An end face (42*a*) of the orbiting lap (42) faces the front surface of the fixed end plate (31). Part of the fixed end plate (31) facing the end face (42*a*) of the orbiting lap (42) is a bottom land (31*a*). In the compression mechanism (20), as shown in FIG. 3, the fixed lap (32) of the fixed scroll (30) and the orbiting lap (42) of the orbiting scroll (40) mesh with each other to form a plurality of crescent-shaped compression chambers (25).

[Detailed Shapes of Fixed Scroll and Orbiting Scroll]

Detailed shapes of the fixed scroll (30) and the orbiting scroll (40) will be described with reference to FIGS. 4 and 5. The detailed shapes of the fixed scroll (30) and the orbiting scroll (40) described below are the shapes of the fixed scroll (30) and the orbiting scroll (40) at room temperature (about 20° C.).

Figure 4:
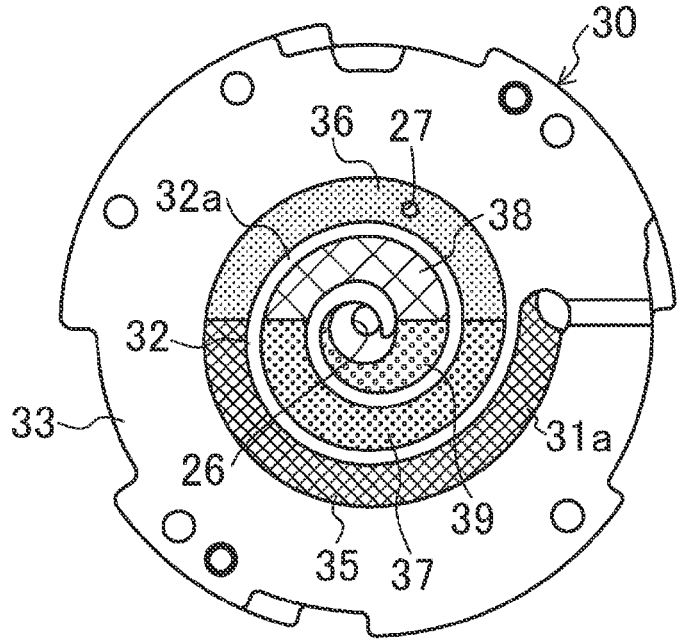
FIG. 4 is a bottom view of a fixed scroll of the embodiment.

As shown in FIG. 4, the bottom land (31*a*) of the fixed end plate (31) is provided with a plurality of regions which are formed along the fixed lap (32), and are located at different distances (depths) from the end face (32*a*) of the fixed lap (32). Specifically, part of the bottom land (31*a*) corresponding to about a half turn from an outer end of the fixed lap (32) constitutes a suction side bottom region (35). Part of the bottom land (31*a*) which is adjacent to the suction side bottom region (35) and corresponds to about a half turn from the suction side bottom region (35) toward an inner end of the fixed lap (32) constitutes an intermediate bottom region (36). Part of the bottom land (31*a*) which is adjacent to the intermediate bottom region (36) and corresponds to about a half turn from the intermediate bottom region (36) constitutes a first discharge side bottom region (37). Part of the bottom land (31*a*) which is adjacent to the first discharge side bottom region (37) and corresponds to about a half turn from the first discharge side bottom region (37) constitutes a second discharge side bottom region (38). Part of the bottom land (31*a*) which is adjacent to the second discharge side bottom region (38) and corresponds to about a half turn from the second discharge side bottom region (38) constitutes a third discharge side bottom region (39). The intermediate bottom region (36) includes part of the bottom land (31*a*) where the injection port (27) is opened. That is, part of the bottom land (31*a*) of the fixed end plate (31) facing the compression chamber (25) communicating with the injection port (27) constitutes the intermediate bottom region (36).

In the fixed scroll (30), a distance from the end face (32*a*) of the fixed lap (32) to the intermediate bottom region (36) is the shortest, and a distance from the end face (32*a*) of the fixed lap (32) to the third discharge side bottom region (39) is the longest. A distance from the end face (32*a*) of the fixed lap (32) to the suction side bottom region (35) is longer than a distance from the end face (32*a*) of the fixed lap (32) to the intermediate bottom region (36), and is equal to a distance from the end face (32*a*) of the fixed lap (32) to the first discharge side bottom region (37). A distance from the end face (32*a*) of the fixed lap (32) to the second discharge side bottom region (38) is longer than a distance from the end face (32*a*) of the fixed lap (32) to the first discharge side bottom region (37), and is shorter than a distance from the end face (32*a*) of the fixed lap (32) to the third discharge side bottom region (39).

Figure 5:
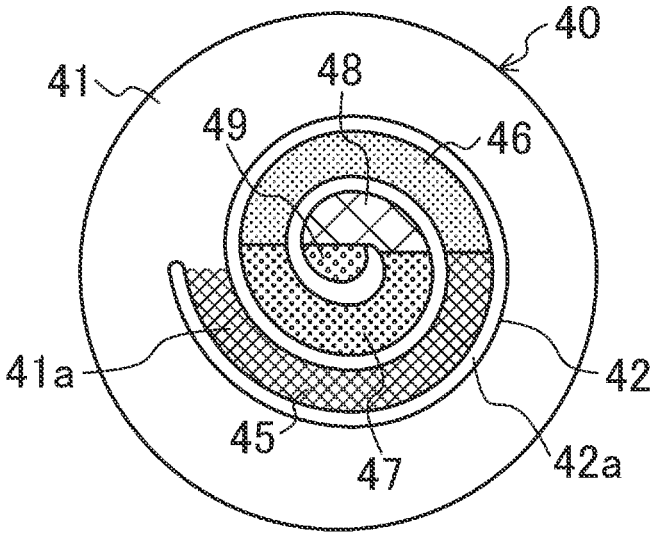
FIG. 5 is a plan view of an orbiting scroll of the embodiment.

As shown in FIG. 5, the bottom land (41*a*) of the orbiting end plate (41) is provided with a plurality of regions which are formed along the orbiting lap (42), and are located at different distances (depths) from the end face (42*a*) of the orbiting lap (42). Specifically, part of the bottom land (41*a*) corresponding to the suction side bottom region (35) of the fixed end plate (31) constitutes a suction side bottom region (45). Part of the bottom land (41*a*) corresponding to the intermediate bottom region (36) of the fixed end plate (31) constitutes an intermediate bottom region (46). Part of the bottom land (41*a*) corresponding to the first discharge side bottom region (37) of the fixed end plate (31) constitutes a first discharge side bottom region (47). Part of the bottom land (41*a*) corresponding to the second discharge side bottom region (38) of the fixed end plate (31) constitutes a second discharge side bottom region (48). Part of the bottom land (41*a*) corresponding to the third discharge side bottom region (39) of the fixed end plate (31) constitutes a third discharge side bottom region (49). Part of the bottom land (41*a*) of the orbiting end plate (41) facing the compression chamber (25) communicating with the injection port (27) constitutes the intermediate bottom region (46).

In the orbiting scroll (40), a distance from the end face (42*a*) of the orbiting lap (42) to the intermediate bottom region (46) is the shortest, and a distance from the end face (42*a*) of the orbiting lap (42) to the third discharge side bottom region (49) is the longest distance from the end face (42*a*) of the orbiting lap (42) to the suction side bottom region (45) is longer than a distance from the end face (42*a*) of the orbiting lap (42) to the intermediate bottom region (46), and is equal to a distance from the end face (42*a*) of the orbiting lap (42) to the first discharge side bottom region (47). A distance from the end face (42*a*) of the orbiting lap (42) to the second discharge side bottom region (48) is longer than a distance from the end face (42*a*) of the orbiting lap (42) to the first discharge side bottom region (47), and is shorter than a distance from the end face (42*a*) of the orbiting lap (42) to the third discharge side bottom region (49).

As described above, the end face (42*a*) of the orbiting lap (42) faces the bottom land (31*a*) of the fixed end plate (31). The bottom land (31*a*) of the fixed end plate (31) is provided with the plurality of regions located at different distances (depths) from the end face (32*a*) of the fixed lap (32). Thus, a clearance between the bottom land (31*a*) of the fixed end plate (31) and the end face (42*a*) of the orbiting lap (42) gradually increases in the order of a clearance between the intermediate bottom region (36) and the orbiting lap (42), a clearance between the first discharge side bottom region (37) and the orbiting lap (42), a clearance between the second discharge side bottom region (38) and the orbiting lap (42), and a clearance between the third discharge side bottom region (39) and the orbiting lap (42), clearance between the suction side bottom region (35) and the orbiting lap (42) is equal to the clearance between the first discharge side bottom region (37) and the orbiting lap (42).

The end face (32*a*) of the fixed lap (32) faces the bottom land (41*a*) of the orbiting end plate (41). The bottom land (41*a*) of the orbiting end plate (41) is provided with the plurality of regions located at different distances (depths) from the end face (42*a*) of the orbiting lap (42). Thus, a clearance between the bottom land (41*a*) of the orbiting end plate (41) and the end face (32*a*) of the fixed lap (32) gradually increases in the order of a clearance between the intermediate bottom region (46) and the fixed lap (32), a clearance between the first discharge side bottom region (47) and the fixed lap (32), a clearance between the second discharge side bottom region (48) and the fixed lap (32), and a clearance between the third discharge side bottom region (49) and the fixed lap (32). A clearance between the suction side bottom region (45) and the fixed lap (32) is equal to the clearance between the first discharge side bottom region (47) and the fixed lap (32).

Thus, as shown in FIG. 2, in the compression mechanism (20), a clearance Ds between the suction side bottom region (35) of the fixed end plate (31) and the end face (42*a*) of an outer end of the orbiting lap (42) is larger than a clearance Dm between the intermediate bottom region (36) of the fixed end plate (31) and the end face (42*a*) of the orbiting lap (42). A clearance Dd between the third discharge side bottom region (39) of the fixed end plate (31) and the end face (42*a*) of an inner end of the orbiting lap (42) is larger than the clearance Ds between the suction side bottom region (35) of the fixed end plate (31) and the end face (42*a*) of the outer end of the orbiting lap (42). In the compression mechanism (20), a clearance Ds between the suction side bottom region (45) of the orbiting end plate (41) and the end face (32*a*) of an outer end of the fixed lap (32) is larger than a clearance Dm between the intermediate bottom region (46) of the bottom land (41*a*) of the orbiting end plate and the end face (32*a*) of the fixed lap (32). A clearance Dd between the third discharge side bottom region (49) of the orbiting end plate (41) and the end face (32*a*) of an inner end of the fixed lap (32) is larger than the clearance Ds between the suction side bottom region (45) of the orbiting end plate (41) and the end face (32*a*) of the outer end of the fixed lap (32).

Working Mechanism

A working mechanism of the scroll compressor (10) will be described below.

In the scroll compressor (10), when the electric motor (50) is energized, the drive shaft (60) drives the orbiting scroll (40). Since the Oldham ring (22) restricts rotation of the orbiting scroll (40), the orbiting scroll (40) does not rotate, but revolves.

When the orbiting scroll (40) revolves, a low pressure gaseous refrigerant which flowed into the compression mechanism (20) through the suction pipe (16) is sucked into the compression chamber (25) through the outer ends of the fixed lap (32) and the orbiting lap (42). When the orbiting scroll (40) further moves, the compression chamber (25) is isolated from the suction pipe (16), i.e., completely closed, and the compression chamber (25) moves along the fixed lap (32) and the orbiting lap (42) toward the inner ends thereof. In this process, a capacity of the compression chamber (25) gradually decreases, and the gaseous refrigerant in the compression chamber (25) is compressed. In the compression mechanism (20), an intermediate pressure gaseous refrigerant is introduced to the completely closed compression chamber (25) in the course of compression from the injection port (27). Thus, in the compression mechanism (20), the low pressure gaseous refrigerant from the suction pipe (16) and the intermediate pressure gaseous refrigerant from the injection port (27) are sucked into the compression chamber (25), and compressed.

When the capacity of the compression chamber (25) gradually decreases as the orbiting scroll (40) moves, the compression chamber (25) communicates with the discharge port (26). The refrigerant compressed in the compression chamber (25) (i.e., a high pressure gaseous refrigerant) flows into the discharge gas passage (28) through the discharge port (26), and then discharged in the inner space of the casing (15) between the compression mechanism (20) and the electric motor (50). The high pressure gaseous refrigerant discharged to the inner space of the casing (15) flows outside the casing (15) through the discharge pipe (18).

When the scroll compressor (10) is operated, the drive shaft (60) rotates, and the refrigeration oil stored in the bottom of the casing (15) is sucked into the oil supply passage in the drive shaft (60). The refrigeration oil flowing through the oil supply passage is supplied to the drive shaft (60) and on the lower bearing (55) sliding relative to each other, and the drive shaft (60) and the compression mechanism (20) sliding relative to each other. The refrigeration oil supplied from the oil supply passage to the compression mechanism (20) is supplied to the main shaft (61) and the housing (21) sliding relative to each other, and the eccentric part (63) and the cylindrical part (43) of the orbiting scroll (40) sliding relative to each other. In the compression mechanism (20), the refrigeration oil is also supplied to the orbiting scroll (40) and the Oldham ring (22) sliding relative to each other, and the orbiting scroll (40) and the fixed scroll (30) sliding relative to each other.

In the compression mechanism (20), the refrigeration oil also flows into the compression chamber (25). The refrigeration oil flowed into the compression chamber (25) lubricates the orbiting lap (42) and the fixed lap (32) sliding relative to each other, the orbiting end plate (41) and the fixed lap (32) sliding relative to each other, and the orbiting lap (42) and the fixed end plate (31) sliding relative to each other. Part of the refrigeration oil flowed into the compression chamber (25) passes through the discharge port (26) in the shape of fine oil drops together with the high pressure gaseous refrigerant, and then discharged from the compression mechanism (20) to the inner space of the casing (15). Part of the refrigeration oil discharged from the compression mechanism (20) together with the high pressure gaseous refrigerant flows outside the casing (15) through the discharge pipe (18).

The refrigeration oil flowed outside the casing (15) together with the high pressure gaseous refrigerant is separated from the gaseous refrigerant in an oil separator which is not shown, and is sent back to the compression mechanism (20) through the injection pipe (17) together with the intermediate pressure gaseous refrigerant. The refrigeration oil supplied from the injection pipe (17) to the compression mechanism (20) passes through the injection port (27), and flows into the compression chamber (25) in the course of compression together with the intermediate pressure gaseous refrigerant.

As described above, part of the bottom land (31*a*) of the fixed end plate (31) of the fixed scroll (30) facing the compression chamber (25) communicating with the injection port (27) constitutes the intermediate bottom region (36). Among the clearances between the bottom land (31*a*) of the fixed end plate (31) and the end face (42*a*) of the orbiting lap (42), the clearance between the intermediate bottom region (36) of the fixed end plate (31) and the end face (42*a*) of the orbiting lap (42) is the smallest. Part of the bottom land (41*a*) of the orbiting end plate (41) of the orbiting scroll (40) facing the compression chamber (25) communicating with the injection port (27) constitutes the intermediate bottom region (46). Among the clearances between the bottom land (41*a*) of the orbiting end plate (41) and the end face (32*a*) of the fixed lap (32), the clearance between the intermediate bottom region (46) of the orbiting end plate (41) and the end face (32*a*) of the fixed lap (32) is the smallest.

The refrigeration oil flows into the compression chamber (25) communicating with the injection port (27) together with the intermediate pressure gaseous refrigerant. Thus, a sufficient amount of the refrigeration oil is surely supplied to the orbiting lap (42) and the intermediate bottom region (36) of the fixed end plate (31) sliding relative to each other, and the intermediate bottom region (46) of the orbiting end plate (41) and the fixed lap (32) sliding relative to each other. Thus, even when the clearance between the intermediate bottom region (36) of the fixed end plate (31) and the end face (42*a*) of the orbiting lap (42) is small, and the clearance between the intermediate bottom region (46) of the orbiting end plate (41)

and the end face (32*a*) of the fixed lap (32) is small, troubles such as seizing etc. is less likely to occur.

The refrigeration oil flowed into the compression chamber (25) from the injection port (27) is hardly supplied to the end face (42*a*) of the orbiting lap (42) and the suction side bottom region (35) of the fixed end plate (31) sliding relative to each other, and the suction side bottom region (45) of the orbiting end plate (41) and the end face (32*a*) of the fixed lap (32) sliding relative to each other. Part of the refrigeration oil discharged from the scroll compressor (10) together with the refrigerant passes through the oil separator, flows through the refrigerant circuit, and then returns to the compression mechanism (20) together with the low pressure gaseous refrigerant. However, when the pressure of the gaseous refrigerant sucked into the compression mechanism (20) is low, a density of the gaseous refrigerant is low. Thus, only a small amount of the refrigeration oil flows into the compression mechanism (A) together with the low pressure gaseous refrigerant. This easily reduces the amount of the refrigeration oil supplied to the end face (42*a*) of the orbiting lap (42) and the suction side bottom region (35) of the fixed end plate (31) sliding relative to each other, and the suction side bottom region (45) of the orbiting end plate (41) and the end face (32*a*) of the fixed lap (32) sliding relative to each other.

According to the compression mechanism (20) of the present embodiment, the clearance between the suction side bottom region (35) of the fixed end plate (31) and the end face (42*a*) of the orbiting lap (42) is larger than the clearance between the intermediate bottom region (36) of the fixed end plate (31) and the end face (42*a*) of the orbiting lap (42). In addition, the clearance between the suction side bottom region (45) of the orbiting end plate (41) and the end face (32*a*) of the fixed lap (32) is larger than the clearance between the intermediate bottom region (46) of the orbiting end plate (41) and the end face (32*a*) of the fixed lap (32). Thus, even when only a small amount of the refrigeration oil is supplied to the end face (42*a*) of the orbiting lap (42) and the suction side bottom region (35) of the fixed end plate (31) sliding relative to each other, and the suction side bottom region (45) of the orbiting end plate (41) and the end face (32*a*) of the fixed lap (32) sliding relative to each other, troubles such as seizing etc. is less likely to occur.

In a process of compressing the refrigerant in the compression chamber (25) (a compression stroke), pressure and temperature of the refrigerant gradually increase. Thus, temperature of the fixed lap (32) and the orbiting lap (42) increases with decreasing distance from the inner end of the lap, and the degree of thermal expansion increases with a decreasing distance from the inner end of the lap.

According to the compression mechanism (20) of the present embodiment, the discharge side bottom regions (37, 38, 39) are formed on the bottom land (31*a*) of the fixed end plate (31), and the clearance between the bottom land (31*a*) of the fixed end plate (31) and the end face (42*a*) of the orbiting lap (42) at room temperature gradually increases with decreasing distance from the inner end of the orbiting lap (42). In addition, the discharge side bottom regions (47, 48, 49) are formed on the bottom land (41*a*) of the orbiting end plate (41), and the clearance between the bottom land (41*a*) of the orbiting end plate (41) and the end face (32*a*) of the fixed lap (32) at room temperature gradually increases with decreasing distance from the inner end of the fixed lap (32). Thus, even when part of the fixed lap (32) or the orbiting lap (42) closer to the inner end of the lap is thermally expanded when the scroll compressor (10) is operated, the clearance between the bottom land (31*a*) of the fixed end plate (31) and the end face (42*a*) of the orbiting lap (42) and the clearance between the bottom land (41*a*) of the orbiting end plate (41) and the end face (32*a*) of the fixed lap (32) are sufficiently maintained. This can prevent troubles such as seizing etc.

Advantages of Embodiment

According to the compression mechanism (20) of the scroll compressor (10) of the present embodiment, the refrigeration oil is introduced from the injection port (27) to the compression chamber (25) in the course of compression, and the clearance between the suction side bottom region (35, 45) where the refrigeration oil is not easily supplied and the lap (42, 32) is larger than the clearance between the intermediate bottom region (36, 46) where a sufficient mount of the refrigeration oil is supplied and the lap (42, 32). Thus, a contact pressure acted on the suction side bottom region (35, 45) of the bottom land (31*a*, 41*a*) and part of the end face (42*a*, 32*a*) of the lap (42, 32) facing the suction side bottom region (35, 45) is lower than a contact pressure acted on the intermediate bottom region (36, 46) of the bottom land (31*a*, 41*a*) and part of the end face (42*a*, 32*a*) of the lap (42, 32) facing the intermediate bottom region (36, 46). Thus, even in the suction side bottom region (35, 45) where the refrigeration oil is not easily supplied, troubles caused by insufficient lubrication, such as seizing etc. between the end plate (31, 41) and the lap (42, 32), can be prevented. This can improve reliability of the scroll compressor (10).

According to the present embodiment, the clearance between the discharge side bottom region (37-39, 47-49) whose temperature is relatively high when the scroll compressor (10) is operated and the lap (42, 32) is larger than the clearance between the intermediate bottom region (36, 46) whose temperature is not as high as the discharge side bottom region (37-39, 47-49) and the lap (42, 32). Thus, even when the lap (32, 42) is thermally expanded when the scroll compressor (10) is operated, excessive reduction of the clearance between the discharge side bottom region (37-39, 47-49) and lap (42, 32) can be prevented. Thus, the present embodiment can prevent seizing etc between the discharge side bottom region (37-39, 47-49) of the bottom land (31*a*, 41*a*) and the lap (42, 32), and can further improve the reliability of the scroll compressor (10).

According to the present embodiment, the clearance between the outer end of the lap (32, 42) whose temperature is relatively low when the scroll compressor (10) is operated and the bottom land (41*a*, 31*a*) is smaller than the clearance between the inner end of the lap (32, 42) whose temperature is relatively high when the scroll compressor (10) is operated and the bottom land (41*a*, 31*a*). Thus, the present embodiment can reduce the clearance between the suction side bottom region (35, 45) and the end face (42*a*, 32*a*) of the lap (42, 32) as much as possible, and can prevent troubles such as seizing etc. between the end plate (31, 41) and the lap (42, 32).

Alternative of Embodiment

In the compression mechanism (20) of the above embodiment, the suction side bottom region (35), the intermediate bottom region (36), and the discharge side bottom regions (37, 38, 39) are funned on the bottom land (31*a*) of the fixed end plate (31), and the clearances between the regions on the bottom land (31*a*) and the end face (42*a*) of the orbiting lap (42) are varied. In addition, the suction side bottom region (45), the intermediate bottom region (46), and the discharge side bottom regions (47, 48, 49) are formed on the bottom land (41*a*) of the orbiting end plate (41), and the clearances between the regions on the bottom land (41*a*) and the end face (32*a*) of the fixed lap (32) are varied.

However, in the compression mechanism (20) of the above-described embodiment, there is no need to provide both of the fixed end plate (31) and the orbiting end plate (41) with the suction side bottom region (35, 45) etc., and only one of the fixed end plate (31) or the orbiting end plate (41) may be provided with the suction side bottom region (35, 45) etc.

Specifically, in the compression mechanism (20) of the above embodiment, only the bottom land (31*a*) of the fixed end plate (31) may be provided with the suction side bottom region (35), the intermediate bottom region (36), and the discharge side bottom regions (37, 38, 39). In this case, in the orbiting scroll (40), a distance from the bottom land (41*a*) of the orbiting end plate (41) to the end face (42*a*) of the orbiting lap (42) is constant along the entire length of the orbiting lap (42). Thus, the clearance between the bottom land (31*a*) of the fixed end plate (31) and the end face (42*a*) of the orbiting lap (42) is varied among the regions, while the clearance between the bottom land (41*a*) of the orbiting end plate (41) and the end face (32*a*) of the fixed lap (32) is constant along the entire length of the fixed lap (32).

In the compression mechanism (20) of the above embodiment, only the bottom land (41*a*) of the orbiting end plate (41) may be provided with the suction side bottom region (45), the intermediate bottom region (46), and the discharge side bottom regions (47, 48, 49). In this case, in the fixed scroll (30), a distance from the bottom land (31*a*) of the fixed end plate (31) to the end face (32*a*) of the fixed lap (32) is constant along the entire length of the fixed lap (32). Thus, the clearance between the bottom land (41*a*) of the orbiting end plate (41) and the end face (32*a*) of the fixed lap (32) is varied among the regions, while the clearance between the bottom land (31*a*) of the fixed end plate (31) and the end face (42*a*) of the orbiting lap (42) is constant along the entire length of the orbiting lap (42).

The above-described embodiment has been set forth merely for the purposes of preferred examples in nature, and is not intended to limit the scope, applications, and use of the invention.

INDUSTRIAL APPLICABILITY

As described above, the present invention is useful for a scroll compressor which is connected to a refrigerant circuit to compress a refrigerant, and in which an intermediate pressure gaseous refrigerant is introduced to a compression chamber in the course of compression.

What is claimed is:

1. A scroll compressor connected to a refrigerant circuit for performing a refrigeration cycle to compress a refrigerant sucked into a compression chamber, comprising:

a fixed scroll having an end plate and a spiral lap protruding from a front surface of the end plate;

an orbiting scroll having an end plate and a spiral lap protruding from a front surface of the end plate of the orbiting scroll, the fixed scroll and the orbiting scroll meshing with each other such that an end face of the lap of one of the fixed scroll or the orbiting scroll faces the front surface of the end plate of the other of the fixed scroll and the orbiting scroll to form the compression chamber; and an injection passage through which an intermediate pressure refrigerant is supplied to the compression chamber in the course of compression, with refrigeration oil separated from a refrigerant discharged from the scroll compressor being supplied to the injection passage together with the intermediate pressure refrigerant, at least one of the fixed scroll and the orbiting scroll having a bottom land facing the lap of the other of the fixed scroll and the orbiting scroll, the bottom land being part of the front surface of the end plate of the at least one of the fixed scroll and the orbiting scroll, the bottom land having an intermediate bottom region facing a part of the compression chamber communicating with the injection passage, and a suction side bottom region located closer to an outer end of the lap than the intermediate bottom region, a clearance between the suction side bottom region and the end face of the lap facing the suction side bottom region being larger than a clearance between the intermediate bottom region and the end face of the lap facing the intermediate bottom region.

2. The scroll compressor of claim 1, wherein the bottom land has a discharge side bottom region located closer to an inner end of the lap than the intermediate bottom region, and a clearance between the discharge side bottom region and the end face of the lap facing the discharge side bottom region is larger than the clearance between the intermediate bottom region and the end face of the lap facing the intermediate bottom region.

3. The scroll compressor of claim 2, wherein a clearance between the bottom land and the end face of the lap facing the bottom land at the outer end of the lap is smaller than a clearance between the bottom land and the end face of the lap facing the bottom land at the inner end of the lap.

* * * * *